US010376053B2

(12) United States Patent
Schallert

(10) Patent No.: US 10,376,053 B2
(45) Date of Patent: Aug. 13, 2019

(54) DRAWER

(71) Applicant: Julius Blum GmbH, Hoechst (AT)

(72) Inventor: Thomas Schallert, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 228 days.

(21) Appl. No.: 14/185,992

(22) Filed: Feb. 21, 2014

(65) Prior Publication Data

US 2014/0167586 A1 Jun. 19, 2014

Related U.S. Application Data

(63) Continuation of application No. PCT/AT2012/000171, filed on Jun. 18, 2012.

(30) Foreign Application Priority Data

Aug. 30, 2011 (AT) ..... A 1233/2011

(51) Int. Cl.
*A47B 88/40* (2017.01)
*A47B 88/90* (2017.01)

(52) U.S. Cl.
CPC ..... *A47B 88/40* (2017.01); *A47B 88/941* (2017.01)

(58) Field of Classification Search
CPC ..... A47B 88/04; A47B 88/0014
USPC ..... 312/348.1, 348.2, 330.1
See application file for complete search history.

(56) References Cited

U.S. PATENT DOCUMENTS 1,468,786 A * 9/1923 Knechtel ..... A47B 88/0014 217/65
1,648,591 A * 11/1927 Repay ..... B65D 9/22 217/65
1,936,733 A 11/1933 Richardson
2,496,184 A * 1/1950 Von Canon ..... A47B 88/941 144/354
3,095,625 A * 7/1963 Propst ..... E04B 1/6129 24/704.1
3,479,070 A * 11/1969 Marateck ..... F16B 5/00 411/971

(Continued)

FOREIGN PATENT DOCUMENTS

CN 101044937 10/2007
CN 101103864 A 1/2008

(Continued)

OTHER PUBLICATIONS

Chinese Search Report dated Feb. 27, 2015 in foreign counterpart Chinese Application No. 201280042166.9 (English translation).

(Continued)

*Primary Examiner* — Daniel J Troy
*Assistant Examiner* — Timothy M Ayres
(74) *Attorney, Agent, or Firm* — Wenderoth, Lind & Ponack, L.L.P.

(57) ABSTRACT

A drawer includes having a drawer side wall, a drawer wall which is produced from a wood material, and having a fitting part (14) which is attached to one of the two end faces of the drawer wall and by which the drawer wall is connected to the drawer side wall. The drawer side wall has a recess for receiving the fitting part, and the drawer wall produced from the wood material, projects into the recess in the drawer side wall by way of that end face which is fitted with the fitting part.

23 Claims, 7 Drawing Sheets

(56) References Cited

U.S. PATENT DOCUMENTS 3,547,472 A * 12/1970 Ehrman ..... A47B 47/0041 312/140
3,652,048 A * 3/1972 Hartman ..... A47B 57/565 108/108
3,752,553 A * 8/1973 Bildahl ..... F16B 12/26 312/111
4,012,090 A * 3/1977 Pfeifer ..... A47B 88/0014 312/263
4,036,542 A 7/1977 Courtwright
4,120,551 A * 10/1978 Godtschalck ..... A47B 88/941 312/348.1
4,372,224 A * 2/1983 Ehrlich ..... A47B 3/06 108/150
4,402,116 A * 9/1983 Schenck ..... F16B 35/06 24/662
4,497,093 A * 2/1985 Haberkorn ..... F16B 12/26 108/159
4,502,807 A * 3/1985 Salice ..... E05B 65/0835 403/11
4,601,523 A 7/1986 Wenzlick et al.
4,664,548 A * 5/1987 Brinkmann ..... F16B 12/2027 403/14
5,163,774 A * 11/1992 Lautenschlager .... A47B 88/956 312/330.1
5,222,791 A * 6/1993 Held ..... A47B 88/00 312/348.4
5,375,923 A * 12/1994 Hall ..... A47B 88/956 312/330.1
5,460,443 A * 10/1995 Ferrari ..... A47B 88/956 312/348.4
5,524,394 A * 6/1996 Szabo, Sr. ..... A47B 46/00 403/331
5,597,221 A * 1/1997 Grieser ..... A47B 88/0014 312/348.1
5,611,637 A * 3/1997 Brustle ..... A47B 88/00 312/111
6,200,062 B1 * 3/2001 You ..... F16B 12/20 403/230
6,612,078 B2 * 9/2003 Hawang ..... A47B 47/042 403/353
6,757,937 B2 * 7/2004 Salice ..... A47B 88/43 16/94 R
7,540,577 B2 * 6/2009 Netzer ..... A47B 88/956 312/348.4
9,644,653 B2 * 5/2017 Reiter ..... F16B 5/0016
9,714,673 B2 * 7/2017 Phillips ..... F16B 12/24
2004/0207302 A1 * 10/2004 Kao ..... A47B 88/0014 312/348.1
2008/0315740 A1 12/2008 Lam et al.
2009/0072691 A1 * 3/2009 Green ..... A47B 88/0014 312/348.2
2011/0085853 A1 * 4/2011 Liu ..... F16B 12/125 103/381
2012/0133259 A1 5/2012 Babucke-Runte et al.

FOREIGN PATENT DOCUMENTS

| | | |
|---|---|---|
| CN | 101511226 | 8/2009 |
| CN | 102014698 A | 4/2011 |
| DE | 93 11 436 | 10/1993 |
| DE | 203 07 353 | 9/2004 |
| DE | 20 2007 001 781 | 1/2008 |
| DE | 20 2009 004 982 | 11/2010 |
| EP | 0012030 A1 | 6/1980 |
| EP | 1 932 448 | 6/2008 |
| GB | 2 064 303 | 6/1981 |
| JP | 53-13929 | 7/1976 |
| WO | 2008/028812 | 3/2008 |
| WO | 2010/036215 | 4/2010 |
| WO | 2010/036215 A2 | 4/2010 |

OTHER PUBLICATIONS

International Search Report (ISR) dated Oct. 5, 2012 in International (PCT) Application No. PCT/AT2012/000171.
Austrian Patent Office Search Report (ASR) dated Apr. 18, 2012 in Austrian Patent Application No. A 1233/2011.

* cited by examiner

DRAWER

BACKGROUND OF THE INVENTION

The present invention concerns a drawer comprising a drawer side wall, a drawer wall made from a wood material, and a fitment portion fixed to one of the two ends of the drawer wall so that the drawer wall made of wood material is connected to the drawer side wall.

The invention further concerns an article of furniture comprising at least one drawer of the kind to be described.

Connecting fitments for connecting a drawer rear wall to a drawer side wall are described in WO 2010/036215 A2, DE 93 11 436 U1, U.S. Pat. No. 1,936,733, DE 20 2009 004 982 U1, EP 1 932 448 A2 and DE 20 2007 001 781 U1.

EP 0 664 982 B1 to the present applicant describes a connecting fitment for fixing a drawer rear wall to a drawer side wall which is in the form of a hollow profile member. The drawer rear wall is made from a wood material or also from an extruded plastic, and can be fixed relative to the drawer side wall by the connecting fitment. In that case, the drawer rear wall can be cut to the desired length and connected by the connecting fitment in a fast assembly procedure. The connecting fitment has a housing-like portion, in the side wall of which there are provided holes for receiving fixing pins arranged on the drawer side wall. That connecting fitment has proved to be very worthwhile in practice, but it will be noted that the connecting fitment has to be bent a number of times in manufacture and requires a relatively large amount of structural space in the assembled position.

SUMMARY OF THE INVENTION

Therefore, the object of the present invention is to provide a drawer of the general kind set forth in the opening part of this specification, while avoiding the above-mentioned disadvantages.

According to the invention, it is therefore provided that the drawer side wall has a recess for receiving the fitment portion. The drawer wall made from the wood material projects into the recess of the drawer side wall with that end which has the fitment portion.

In other words, a compact fitment portion is arranged in the recess in the drawer side wall and is connected both to the drawer side wall and also to the drawer wall made from a wood material. An end region of the drawer wall also projects into the recess in the drawer side wall. Thus, the fitment portion in the assembled condition can be received completely within the recess so that the end of the drawer wall made from a wood material also lies within the wall thickness of the drawer side wall. In that arrangement, the drawer wall can bear directly against the drawer side wall, and the fitment portion in the mounted condition is invisible viewed from the interior of the drawer.

In the region of the recess, the drawer side wall can have holding elements for receiving the fitment portion, and the fitment portion is to be fixed relative to the drawer side wall in a positively locking relationship and/or force-locking relationship. For that purpose, the fitment portion can have a fixing limb with openings for receiving the holding elements provided on the drawer side wall. In that arrangement, the openings in the fitment portion are arranged so that the holding elements of the drawer side wall can engage behind them.

In an embodiment, the holding elements are in the form of latching elements which can be snap-engaged in the openings in the fixing limb. The latching elements which comprise plastic can be elastically deformable so that they can be latched with the openings in the fitment portion without the use of a tool.

The drawer side wall is in the form of a hollow-chamber profile member made of metal or plastic, and the drawer wall extends transversely relative to the drawer side wall and preferably is in the form of the drawer rear wall. Equally, the drawer wall can be in the form of a front wall or front panel of a drawer which is to be connected to the front end of the drawer side wall. In that case, the holding elements for fixing the front wall would have to be arranged at a front end region of the drawer side wall.

The article of furniture according to the invention has at least one drawer of the described kind.

BRIEF DESCRIPTION OF THE DRAWINGS

Further details and advantages of the present invention will be described by way of example illustrated in the Figures in which.

DETAILED DESCRIPTION OF THE INVENTION

Figure 1:
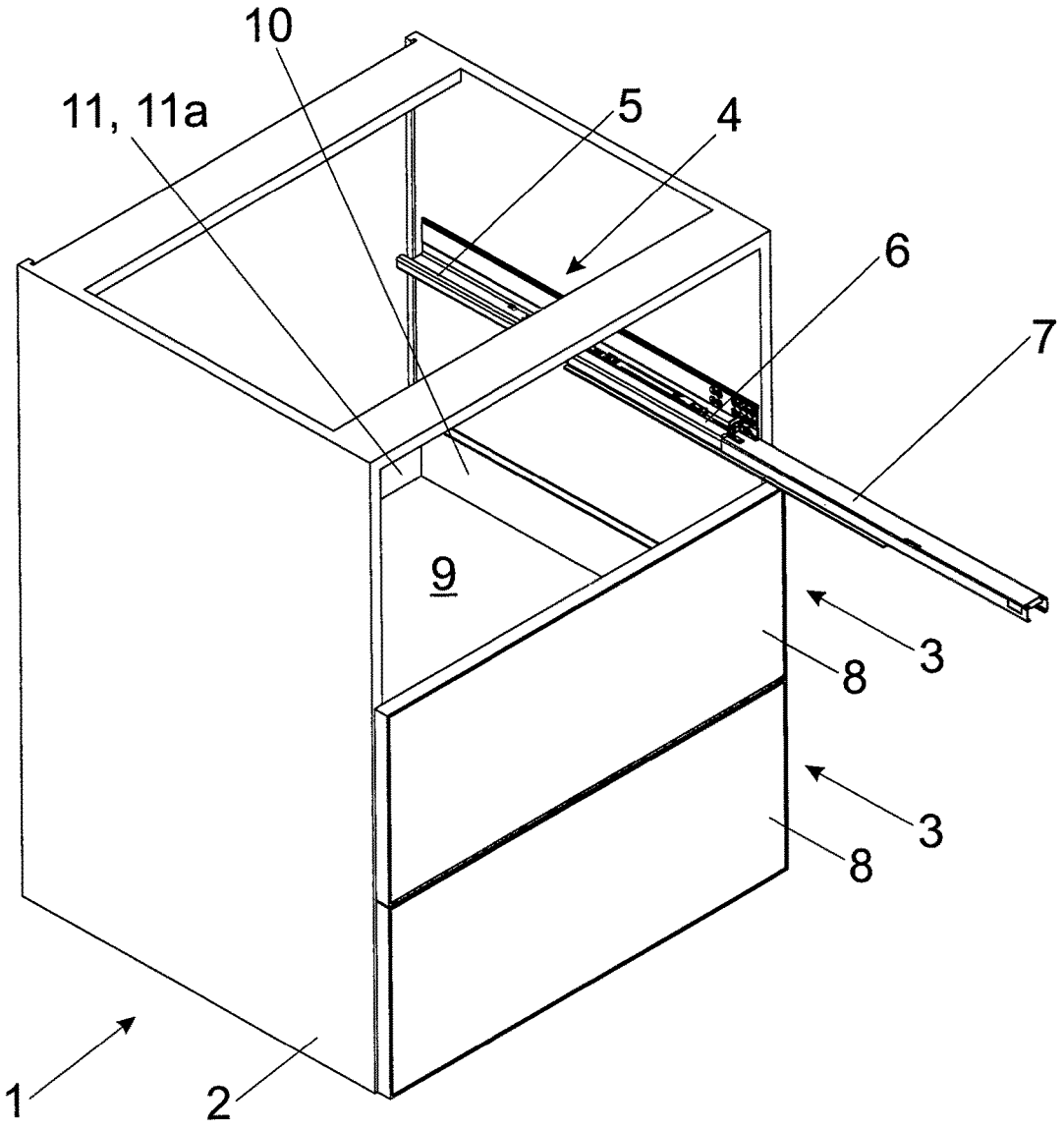
FIG. 1 is a perspective view of an article of furniture with displaceable drawers.

FIG. 1 is a perspective view of an article of furniture 1, wherein drawers 3 are supported displaceably relative to a furniture carcass 2 by drawer extension guides 4. The drawers 3 each have a drawer bottom 9, drawer side walls 10, and a further drawer wall 11 in the form of a drawer rear wall 11*a*, and the drawer side wall 10 and the drawer rear wall 11*a* are to be connected together by a fitment portion 14 that is still to be described. The drawer extension guide 4 has a carcass rail 5 to be fixed to the furniture carcass 2 and at least one displaceable drawer rail 7, and the drawer extension guide 4 can optionally also include a central rail 6 to increase the extension length.

Figure 2:
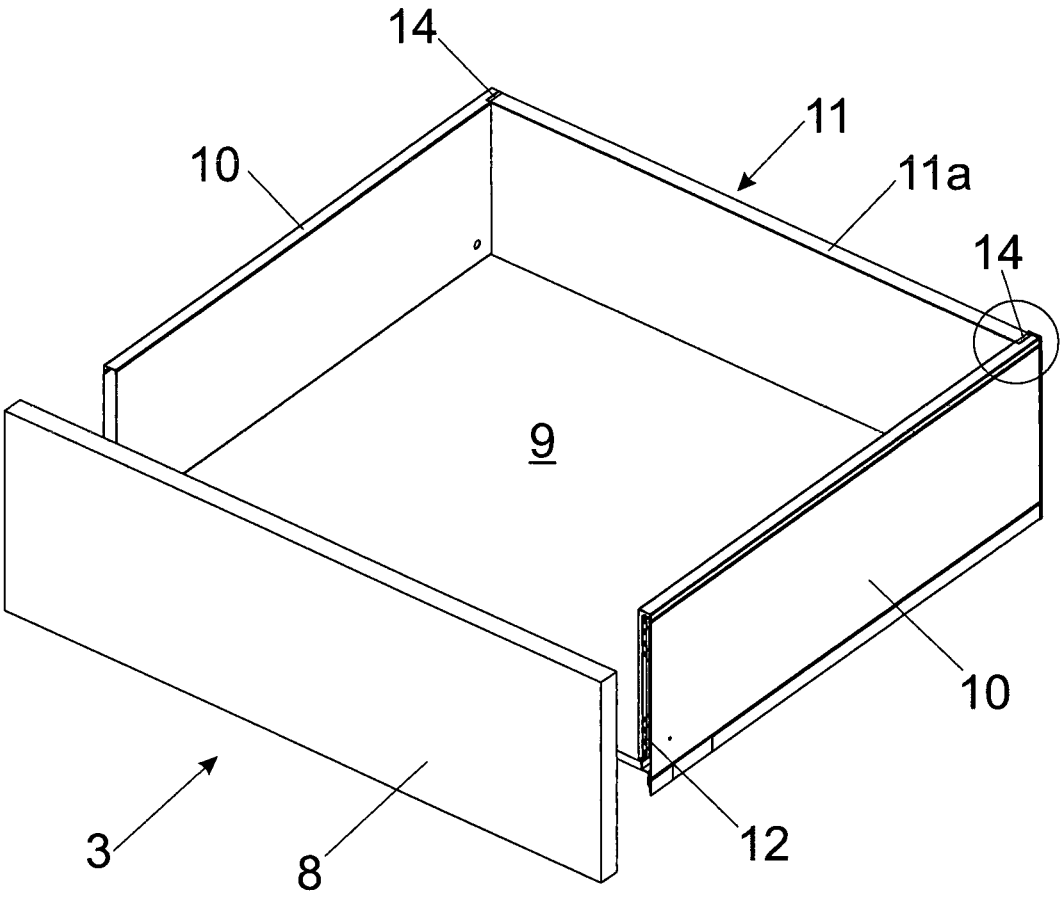
FIG. 2 is a perspective view of a drawer.

FIG. 2 shows a perspective view of the drawer 3, wherein the front panel 8 can be releasably latched with a latching device 12 arranged in the drawer side wall 10, by holding portions (not visible here) which are pre-mounted to the rear side of the front panel 8. The drawer side wall 10 is in the form of a—preferably metal—hollow profile member. It is possible to see a further drawer wall 11 in the form of a drawer rear wall 11*a* made of wood. The drawer rear wall 11*a* is connected to the drawer side walls 10 by fitment portions 14. The fitment portions 14 are completely received within the wall thickness of the drawer side walls 10 so that the drawer rear wall 11*a* can bear directly against the two drawer side walls 10.

Figure 3:
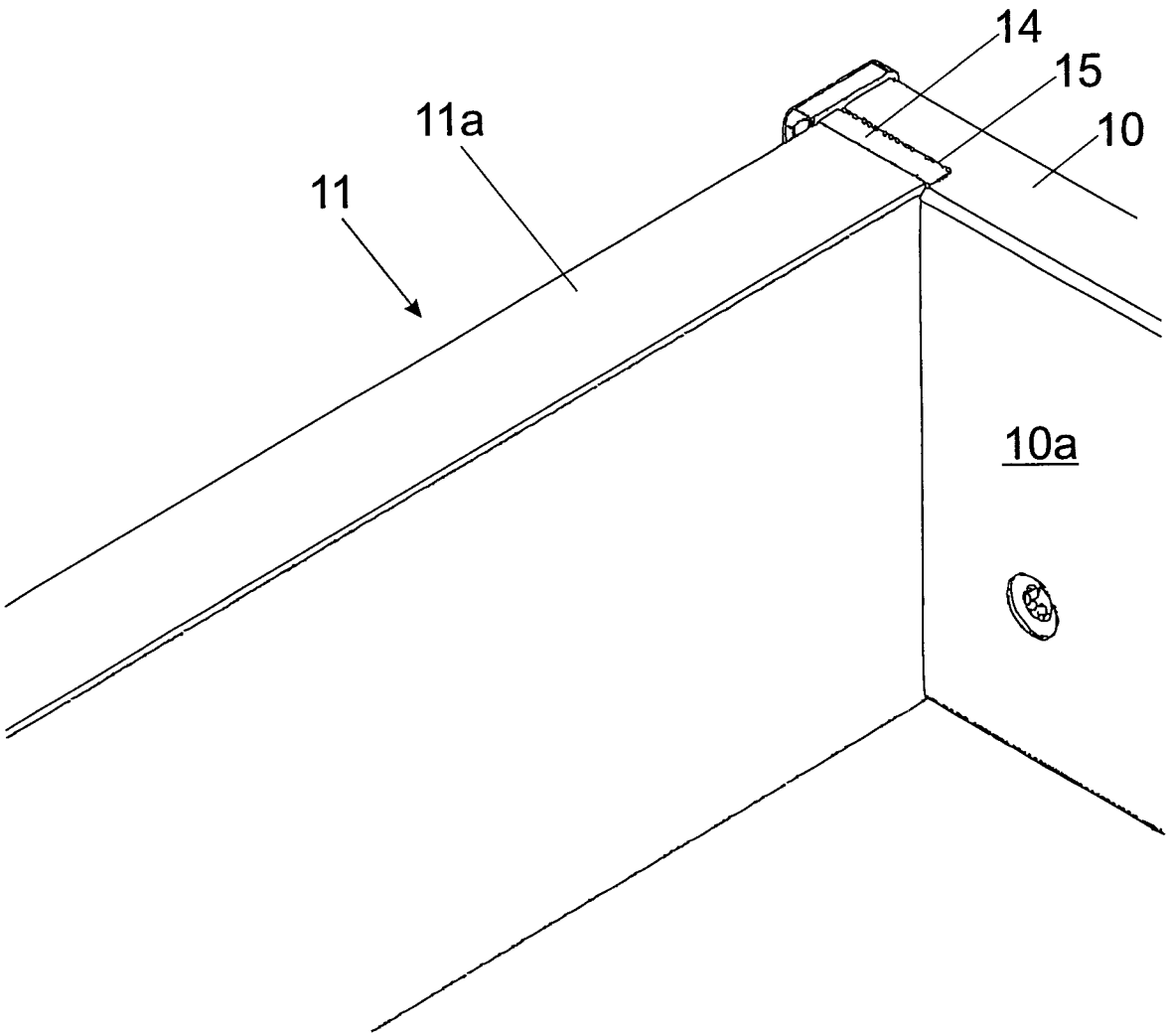
FIG. 3 is a perspective view of the connecting region between the drawer side wall and the drawer rear wall.

FIG. 3 shows the connection region between the drawer side wall 10 and the drawer rear wall 11*a*. In the rear end region, the drawer side wall 10 has a vertically extending recess 15 in which the fitment portion 14 is fitted, and is connected to holding elements 20 (see FIG. 6*b*) arranged at the drawer side wall 10. The drawer rear wall 11*a* is also connected to the fitment portion 14, and its end projects into the recess 15 in the drawer side wall 10 so that the drawer rear wall 11*a* still somewhat overlaps with the inner profile wall 10*a* of the drawer side wall 10. Thus, the fitment portion 14 is invisible as viewed from the interior of the drawer 3, thereby affording a particularly aesthetic configuration of the drawer 3. The drawer side wall 10 can have a substantially rectangular configuration in cross-section.

Figure 4A:
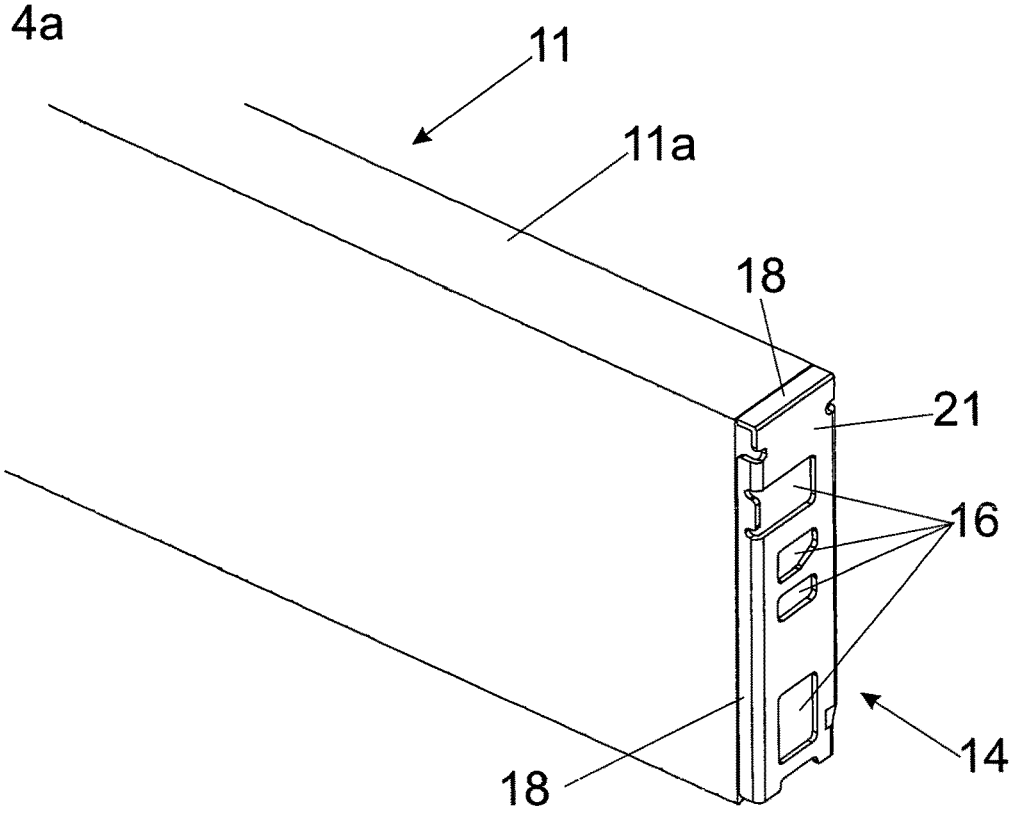
FIGS. 4*a* and 4*b* are two different perspective views of the drawer rear wall with the fitment portion fixed thereto.

FIG. 4*a* shows the fitment portion 14 fixed to the end of the drawer rear wall 11*a* and the height of which substantially corresponds to the height of the drawer rear wall 11*a*. The fitment portion 14 has at least one opening 16 (or a plurality thereof) for receiving the holding elements 20 arranged on the drawer side wall 10. The openings 16 are arranged at a spacing relative to the end of the drawer rear wall 11*a*, which in the illustrated embodiment is made possible by spacer legs 18 of the fitment portion 14, which project at a right angle from a plate-shaped fixing limb 21 of the fitment portion 14 and bear against the end of the drawer rear wall 11*a*.

Figure 4B:
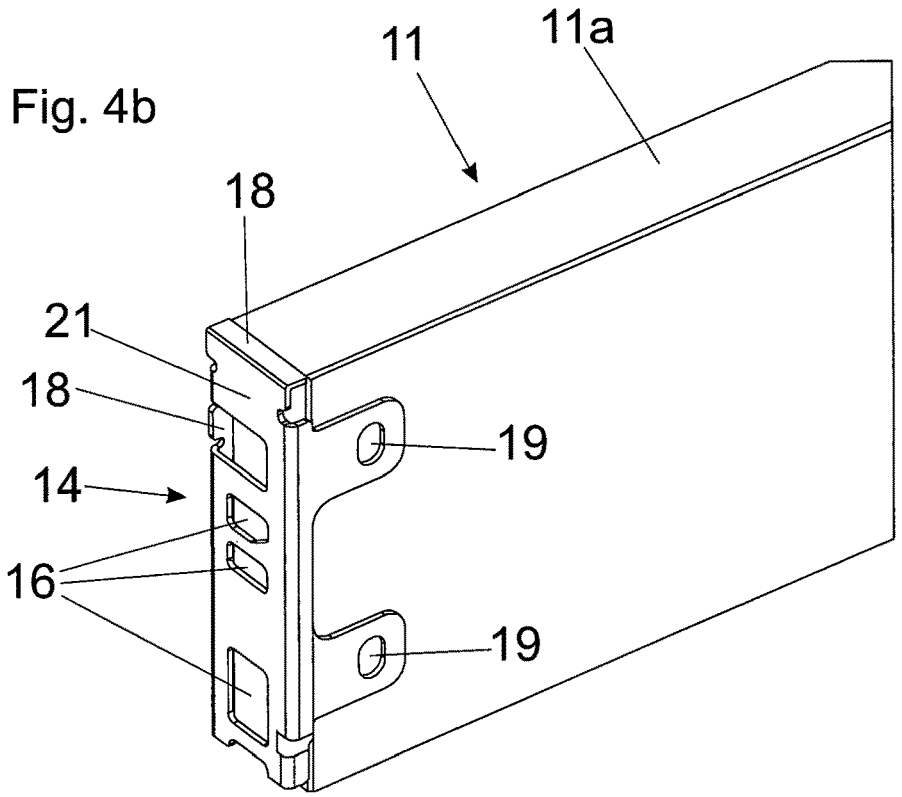

FIG. 4*b* shows a perspective view of the rear side of the drawer rear wall 11*a*, in which respect it is possible to see the fixing locations 19 for securing the drawer rear wall 11*a*. The fixing locations 19 are arranged on tongues of the fitment portion 14, which project at a right angle from the fixing limb 21 and bear against the rear side of the drawer rear wall 11*a*. The provision of the tongues on which the fixing locations 19 are provided can however be omitted. It would also be possible for one or more screws to be screwed into the end of the drawer rear wall 11*a*, from the perpendicular fixing limb 21 of the fitment portion 14. In addition, it would be possible for the spacer legs 18 of the fitment portion 14 to embrace the drawer rear wall 11*a* so that the cut edges of the drawer rear wall 11*a* are concealed. In that way, the cut edges of the drawer rear wall 11*a* become invisible from the outside, in which case it is possible to dispense with precise finishing of those cut edges.

Figure 5:
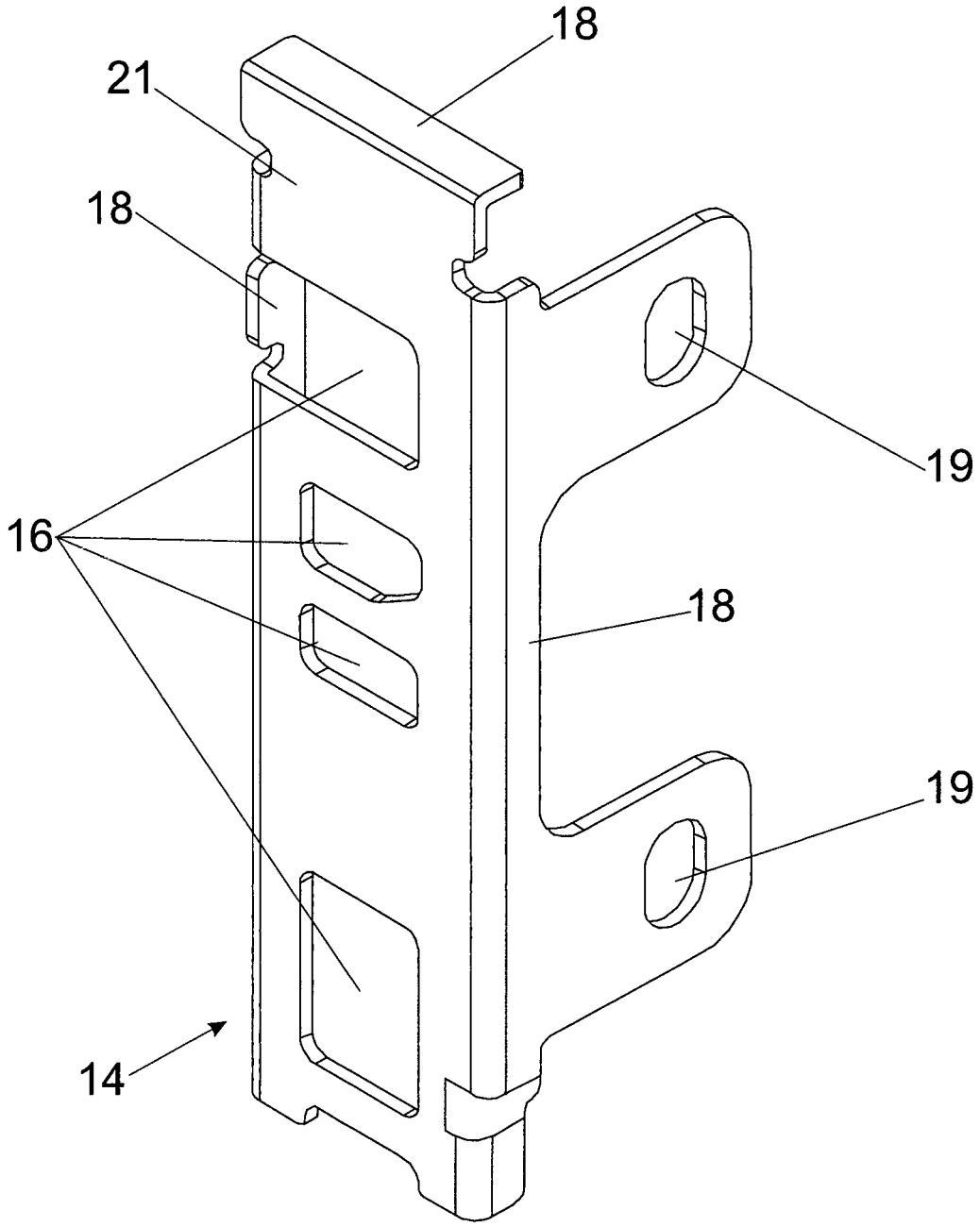
FIG. 5 is a perspective view of the fitment portion.

FIG. 5 shows a perspective view of the fitment portion 14, wherein the drawer rear wall 11*a* is received within the L-shaped profile of the fitment portion 14. Screws can be passed through the fixing locations 19, to be screwed into the rear side of the drawer rear wall 11*a* in the assembly procedure. It is possible to see the openings 16 on the fixing limb 21 for receiving the holding elements 20 mounted to the drawer side wall 10. The spacer legs 18 which are bent from the end of the fitment portion 14 serve for spacing the openings 16 relative to the end of the drawer rear wall 11*a* so that the holding elements 20 of the drawer side wall 10 can reliably engage behind the openings 16. The fitment portion 14 is made in one piece and is preferably produced from metal.

Figure 6A:
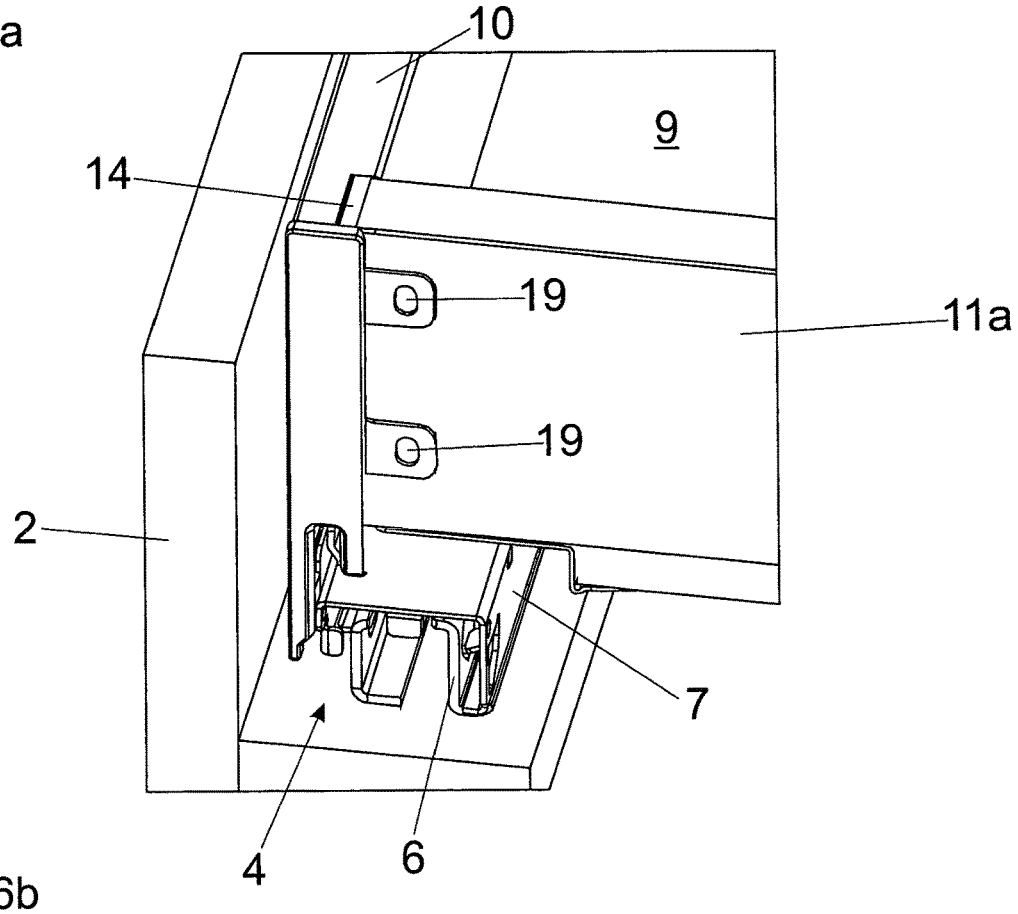
FIGS. 6*a* and 6*b* is a perspective view and a sectional view of the rear end region of the drawer.

FIG. 6*a* shows a perspective view from the rear of the rear end region of the drawer 3. It is possible to see the drawer extension guide 4 with the central rail 6 and the drawer rail 7 which is to be connected to the drawer 3. The drawer rear wall 11*a* is connected to the drawer side wall 10 by the fitment portion 14, and the end of the drawer rear wall 11*a* projects into the wall thickness of the drawer side wall 10.

Figure 6B:
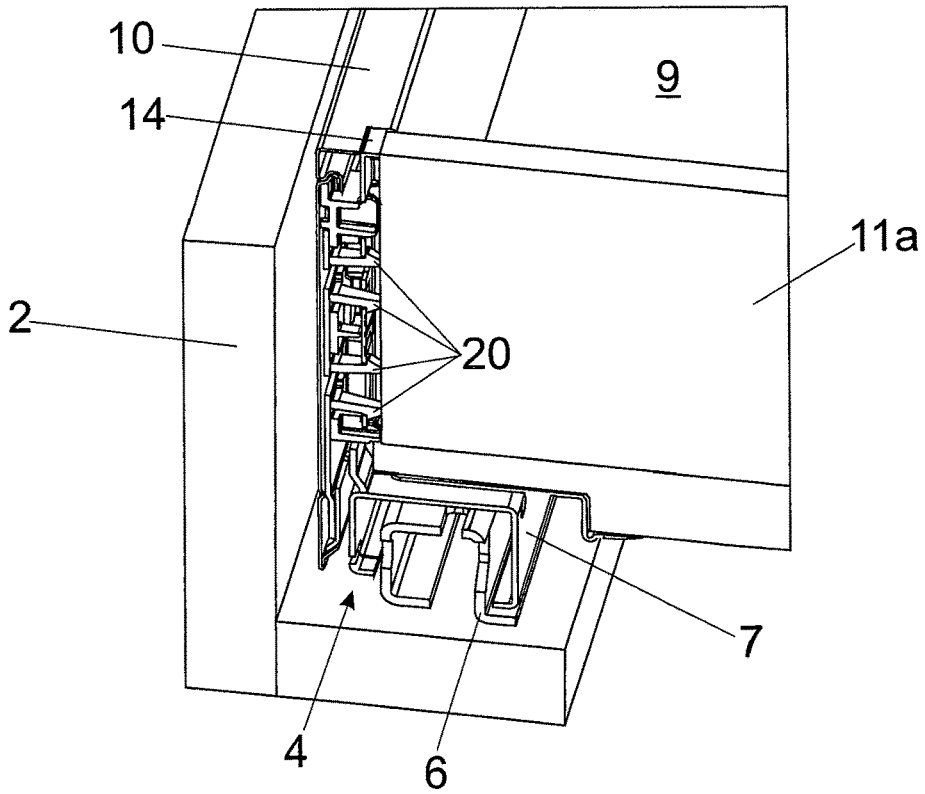
Figure 7:
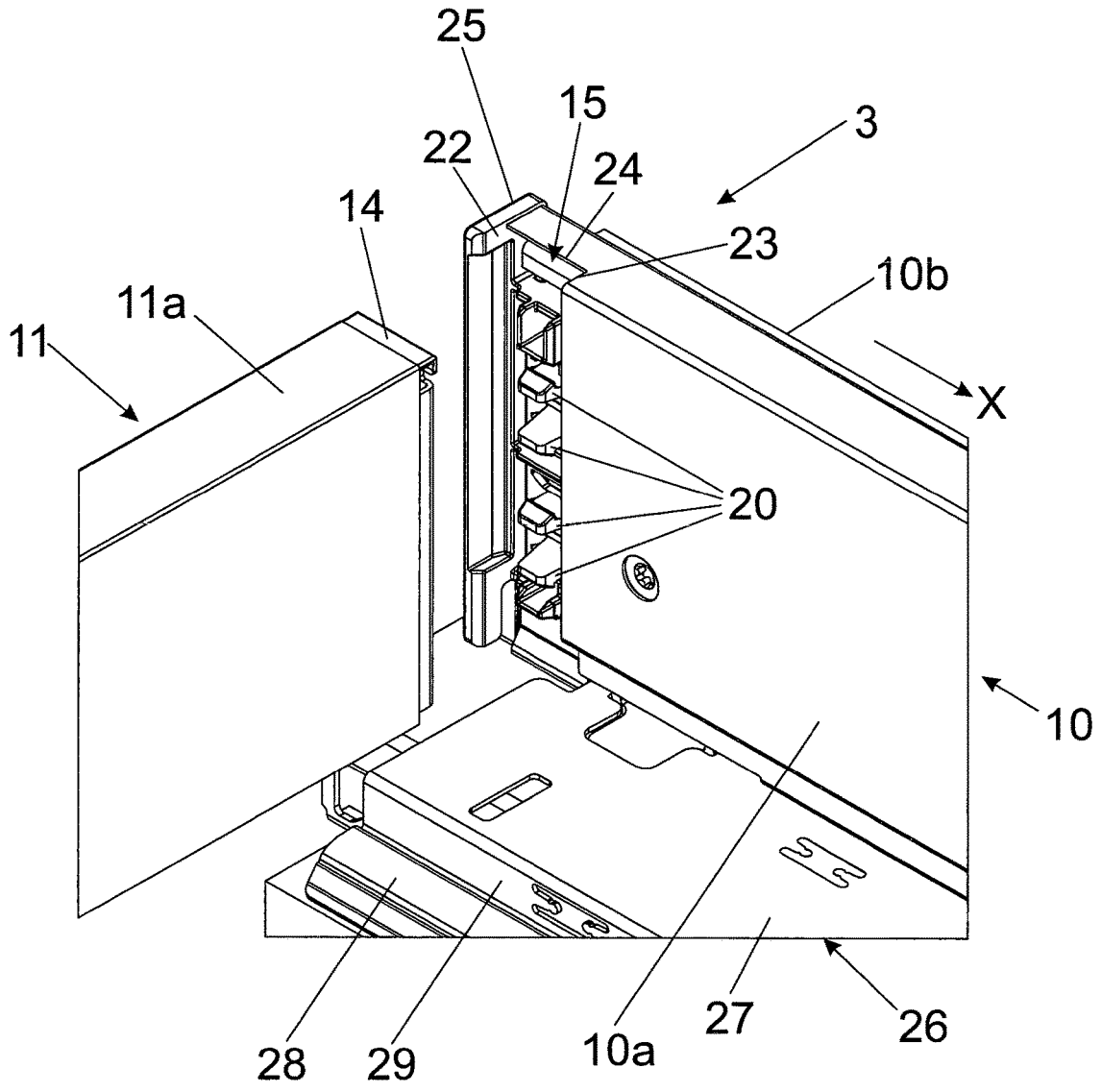
FIG. 7 is the rear end region of the drawer side wall with the drawer wall to be connected.

FIG. 6*b* shows a sectional view of the structure shown in FIG. 6*a*. In the rear end region, the drawer side wall 10 has holding elements 20 which are received in the openings 16 in the fitment portion 14. The holding elements 20 are preferably in the form of latching projections which can be snap-engaged in the openings 16 of the fitment portion 14. The holding elements 20 can be, for example, in the form of elastically deformable latching projections, and the fitment portion 14 pre-mounted to the drawer rear wall 11*a* can be latchingly engaged on to the holding elements 20 without a tool. In the illustrated Figure, each of the holding elements (latching projections) 20 has a hooked configuration with a claw at an end thereof. As illustrated in FIGS. 6*b* and 7, the claw of each of the holding elements (latching projections) 20 has an inclined surface and a shoulder portion. Thus, each latching projection 20 can be introduced into a respective one of the openings 16 of the fitment portion 14 by bending the latching projection in a vertical direction as the inclined surface of the claw contacts an edge of the respective opening 16, and each latching projection 20 is secured against being withdrawn therefrom when the elastically-deformable latching projection 20 resiliently returns to form so that the shoulder of each claw contacts a rear surface of the fitment portion 14. The holding elements 20 can be brought into a release position by applying pressure in opposition to their resilient action so that the fitment portion 14 (and therewith the drawer rear wall 11*a*) can be separated from the drawer side wall 10.

FIG. 7 shows the rear region of the drawer 3 or the rear end portion of the drawer side wall 10 with the drawer wall 11 to be fixed thereto, in the form of the wood rear wall 11*a*. Fixed to the end of the drawer wall 11 is the fitment portion 14 which is latchable to the holding elements 20 arranged on the drawer side wall 10. The illustrated embodiment has a plurality of holding elements 20 which are spaced in a height-wise direction of the drawer side wall 10 and which extend in a direction facing at a right angle to the drawer longitudinal direction X and in a direction facing in the direction of the center of the drawer box. In the mounted position, the fitment portion 14 is received within the recess 15 of the drawer side wall 10, the recess 15 having a U-shaped configuration in plan view. In other words, the recess 15 is defined by limbs 22, 23 extending transversely relative to the drawer longitudinal direction X and a bar 24 which connects the limbs 22, 23 and which extends in the drawer longitudinal direction X. The bar 24 is provided on a rear cover cap 25 which is separate from the drawer side wall 10 but which is connected thereto in a positionally fixed relationship. The drawer side wall 10 is in the form of a hollow profile member with an inner profile wall 10*a* and an outer profile wall 10*b*. Those two profile walls 10*a* and 10*b* extend substantially parallel to each other, and in the assembled position the fitment portion 14 is disposed between those two profile walls 10*a*, 10*b*. Connected to the drawer side wall 10 is a carrier rail 26 having two vertically mutually spaced horizontal limbs 27 and 28 connected together by a vertical leg 29. The carrier rail 26 is mounted at the lateral edge of the drawer bottom 9, preferably in a recess which is open towards the edge of the drawer bottom 9. In the assembled position, the carrier rail 26 embraces the drawer rail 7 of the drawer extension guide 4 from above, with a portion which is profiled in a U-shape in cross-section.

The present invention is not limited to the illustrated embodiment, but includes or extends to all variants and technical equivalents which can fall within the scope of the appended claims. The positional references adopted in the description such as for example up, down, lateral and so forth are also related to the directly described and illustrated Figure and are to be appropriately transferred to the new position upon a change in position.

The invention claimed is:

1. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are arranged in pairs, each pair of latching projections having claws protruding in opposite directions such that the latching projections of each pair of latching projections elastically deform in opposite directions while the latching projections are inserted into the openings; and wherein the height of the fitment portion is at least equal to the height of the drawer end wall.

2. The drawer according to claim 1, wherein the fitment portion has a spacer leg configured so that, in the mounted condition, the spacer leg is completely accommodated within the recess.

3. The drawer according to claim 1, wherein the openings in the fixing limb are spaced from the end of the drawer end wall by at least one spacer leg of the fitment portion.

4. The drawer according claim 1, wherein the fitment portion has at least one fixing location for fixing the fitment portion to the drawer end wall.

5. The drawer according to claim 4, wherein the fitment portion further has a tongue, the at least one fixing location being located on the tongue of the fitment portion.

6. The drawer according to claim 5, wherein the fixing location is an opening configured to allow a screw to pass therethrough to allow the screw to penetrate into the drawer end wall.

7. The drawer according to claim 1, wherein the fitment portion is substantially L-shaped, and an end region of the drawer end wall is received in the L-shaped fitment portion.

8. The drawer according to claim 1, wherein the drawer rear wall extends transversely relative to the drawer side wall.

9. The drawer according to claim 1, wherein the inner profile wall and the outer profile wall extend substantially parallel to each other.

10. The drawer according to claim 9, wherein, in the assembled position, the fitment portion is between the inner profile wall and the outer profile wall.

11. The drawer according to claim 1, wherein the recess in the drawer side wall is substantially U-shaped when viewed in plan view, the U-shaped recess being formed by two limbs extending transversely relative to the longitudinal direction of the drawer and a bar connecting the limbs.

12. The drawer according to claim 1, further comprising a cover cap arranged at a rear end of the drawer side wall, the cover cap being connected in a positionally fixed relationship to the drawer side wall, a limb being formed on the cover cap.

13. An article of furniture comprising at least one drawer according to claim 1.

14. The drawer according to claim 1, wherein the fitment portion has a tongue extending in a longitudinal direction of the drawer end wall, the tongue having a fixing location for fixing the fitment portion to the drawer end wall.

15. The drawer according to claim 1, wherein the fitment portion has at least one spacer leg extending orthogonally from the plate-shaped fixing limb towards a surface of the end of the drawer end wall so as to create a space between the surface of the end of the drawer end wall and the rear surface of the fixing limb, a distal end of the holding elements being received within the space.

16. The drawer according to claim 1, wherein the latching projections are configured to elastically-deform as the latching projections are inserted into the respective one of the openings in one direction so as to snap-engage the fitment portion by movement in the one direction.

17. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are arranged in pairs, each pair of latching projections having claws protruding in opposite directions such that the latching projections of each pair of latching projections elastically deform in opposite directions while the latching projections are inserted into the openings; and wherein the fitment portion is substantially L-shaped, and an end region of the drawer end wall is received in the L-shaped fitment portion.

18. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are arranged in pairs, each pair of latching projections having claws protruding in opposite directions such that the latching projections of each pair of latching projections elastically deform in opposite directions while the latching projections are inserted into the openings;

wherein the fitment portion has at least one fixing location for fixing the fitment portion to the drawer end wall, and the fitment portion has a tongue, the at least one fixing location being located on the tongue of the fitment portion; and wherein the fixing location is an opening configured to allow a screw to pass therethrough to allow the screw to penetrate into the drawer end wall.

19. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are arranged in pairs, each pair of latching projections having claws protruding in opposite directions such that the latching projections of each pair of latching projections elastically deform in opposite directions while the latching projections are inserted into the openings; and wherein the fitment portion has a tongue extending in a longitudinal direction of the drawer end wall, the tongue having a fixing location for fixing the fitment portion to the drawer end wall.

20. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are configured to elastically-deform as the latching projections are inserted into the respective one of the openings in one direction so as to snap-engage the fitment portion by movement in the one direction; and wherein the height of the fitment portion is at least equal to the height of the drawer end wall.

21. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are configured to elastically-deform as the latching projections are inserted into the respective one of the openings in one direction so as to snap-engage the fitment portion by movement in the one direction; and wherein the fitment portion is substantially L-shaped, and an end region of the drawer end wall is received in the L-shaped fitment portion.

22. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are configured to elastically-deform as the latching projections are inserted into the respective one of the openings in one direction so as to snap-engage the fitment portion by movement in the one direction;

wherein the fitment portion has at least one fixing location for fixing the fitment portion to the drawer end wall, and the fitment portion has a tongue, the at least one fixing location being located on the tongue of the fitment portion; and wherein the fixing location is an opening configured to allow a screw to pass therethrough to allow the screw to penetrate into the drawer end wall.

23. A drawer comprising:

a drawer side wall formed as a hollow-chamber profile member, the drawer side wall comprising an inner profile wall and an outer profile wall spaced apart from each other;

a drawer front wall;

a drawer rear wall made from a wood material;

a latching device arranged within the drawer side wall between the inner profile wall and the outer profile wall, the latching device being configured to releasably attach the drawer side wall to the drawer front wall; and a fitment portion fixed to an end of the drawer rear wall to connect the drawer rear wall to the drawer side wall, the fitment portion having a plate-shaped fixing limb, the plate-shaped fixing limb having openings;

wherein the drawer side wall has elastically-deformable latching projections for engaging the fitment portion, each of the latching projections having a claw on an end thereof, the claw having an inclined surface and a shoulder portion;

wherein the drawer side wall has a recess for receiving the fitment portion, and the latching projections being arranged on the drawer side wall within the recess;

wherein the end of the drawer rear wall having the fitment portion fixed thereto projects into the recess of the drawer side wall so that the plate-shaped fixing limb is arranged entirely within the recess, the latching projections being configured to protrude through the openings of the fixing limb of the fitment portion and elastically-deform when the inclined surface of the claw of each of the latching projections contacts an edge of a respective one of the openings in the fitment portion, and to snap-engage the fitment portion when the elastically-deformable latching projections resiliently return to form after the claw passes through the respective one of the openings so that the shoulder portion of the claw of each of the latching projections rests against the rear surface of the fixing limb;

wherein the latching projections are configured to elastically-deform as the latching projections are inserted into the respective one of the openings in one direction so as to snap-engage the fitment portion by movement in the one direction; and wherein the fitment portion has a tongue extending in a longitudinal direction of the drawer end wall, the tongue having a fixing location for fixing the fitment portion to the drawer end wall.

* * * * *